US006142136A

United States Patent [19]

Velasco

[11] Patent Number: 6,142,136

[45] Date of Patent: Nov. 7, 2000

[54] RELEASABLE PAINT BALL GUN BOLT

[76] Inventor: George Velasco, 2201 Clark La., Redondo Beach, Calif. 90278

[21] Appl. No.: 08/951,045

[22] Filed: Oct. 15, 1997

[51] Int. Cl.[7] ..... F41B 11/00

[52] U.S. Cl. ..... 124/71; 124/72; 124/73; 124/74

[58] Field of Search ..... 124/72, 73, 71, 124/74, 75, 76, 77, 41.1; 89/7

[56] References Cited

U.S. PATENT DOCUMENTS 5,462,042 10/1995 Greenwell ..... 124/76
5,497,758 3/1996 Dobbins et al. ..... 124/73
5,542,406 8/1996 Oneto ..... 124/73
5,791,327 8/1998 Riggs et al. ..... 124/71

*Primary Examiner*—J. Woodrow Eldred

[57] ABSTRACT

A compressed gas gun which includes a bolt assembly which is easily removed without the necessity of disassembling the gun or special tooling. The bolt is located at the back of the gun barrel and operatively connected to the hammer assembly by a retracting pin member positioned within an aperture formed in the hammer assembly. By depressing a spring tensioned component at the rear of the bolt, the restraining pin member is caused to move along a groove, or channel, formed in a channel member, raising the pin member from the aperture in the hammer assembly from the gun and allowing the bolt assembly to be removed from the gun. The bolt assembly is reinstalled by reversing the above process.

10 Claims, 3 Drawing Sheets

RELEASABLE PAINT BALL GUN BOLT

BACKGROUND OF THE INVENTION

The present invention relates to improved compressed gas powered guns wherein the bolt assembly is removed by simply depressing a spring tensioned mechanism.

DESCRIPTION OF THE PRIOR ART

Compressed gas powered guns, such as marking guns for firing paint balls typically include a compressed gas source, a projectile supply magazine for supplying paint balls, a barrel through which the projectiles are discharged as fed by gravity from the magazine, and a firing mechanism including a trigger and a slidable bolt assembly to release compressed gas from its source to expel the projectile through the barrel.

The barrel of paint balls guns and the chamber behind it, must be periodically cleaned to remove foreign material collected therein, such as the contents of a projectile which did not fire properly and as a result, dispersed within the gun. In order to clean the gun, the bolt must be removed, which requires disassembling the gun using tools, increasing the costs of maintaining the gun.

U.S. Pat. No. 5,542,406 to Oneto describes a bolt assembly that can retract and does not damage a misaligned paint ball hanging up in the gun breech. U.S. Pat. No. 5,586,541 to McCaslin describes a compressed gas gun which includes various features, such as the use of a thermoplastic compression sleeve, an anti-rebound lock, a slidable barrel and, in a second embodiment, a slidable bolt assembly for actuating a gas releasing valve; U.S. Pat. No. 5,462,042 to Greenwell discloses a gas powered paint ball gun wherein the gas is expanded three times in succession for each firing of the gun, the gun requiring disassembly in order to remove the bolt; U.S. Pat. Nos. 5,505,188 and 5,572,982 to Williams disclose a bolt assembly and valve wherein a small amount of gas initially is allowed to flow through the gas outlet of the bolt and then allow the full force of the gas to flow through the gas outlet enabling the ball to start rolling before the full force of the gas impact the ball thereby minimizing breakage of the gas ball in the gun barrel; and U.S. Pat. No. 5,494,024 to Scott discloses a paint ball gun having a rotary breech which eliminates prior art bolts and spring assemblies.

Although the patents disclose various compressed gas gun systems for discharging projectiles, such as paint balls, a system for simply a releasing a bolt to allow the cleaning of the gun barrel without the necessity of special tooling is not disclosed.

SUMMARY OF THE PRESENT INVENTION

The present invention provides a compressed gas powered gun wherein the bolt mechanism can be removed from the gun by simply depressing a spring loaded elongated rod member slidable movable within the bolt member. A cylindrical rod having a guide pin extending from the upper portion is positioned in a recess formed in the bolt. A member having a channel formed therein is also positioned within said recess, the guide pin being positioned within said channel at a first location when the bolt is secured within the gun. In this position, the rod extends through an opening in the bolt through a coaligned opening in the adjacent hammer, or cocking, mechanism securing the bolt to mechanism. The front portion of the spring loaded rod member is in engagement with the channel member. When it is desired to remove the bolt from the gun, the user depresses the portion of the rod member extending beyond the bolt housing causing the front portion of the rod member to push against the channel member. The guide pin moves up the channel and in doing so lifts the rod from the coaligned openings, allowing the bolt to be removed from the gun. The process is reversed during the reinstallation procedure.

The present invention thus provides a relatively simple procedure for removing and reinstalling a bolt assembly used in compressed gas powered gun for firing fragile projectiles.

BRIEF DESCRIPTION OF THE DRAWING

For a better understanding of the invention, as well as other objects and further features thereof, reference is made to the following description which is to be read in conjunction with the accompanying drawing wherein.

DESCRIPTION OF THE INVENTION

Figure 1:
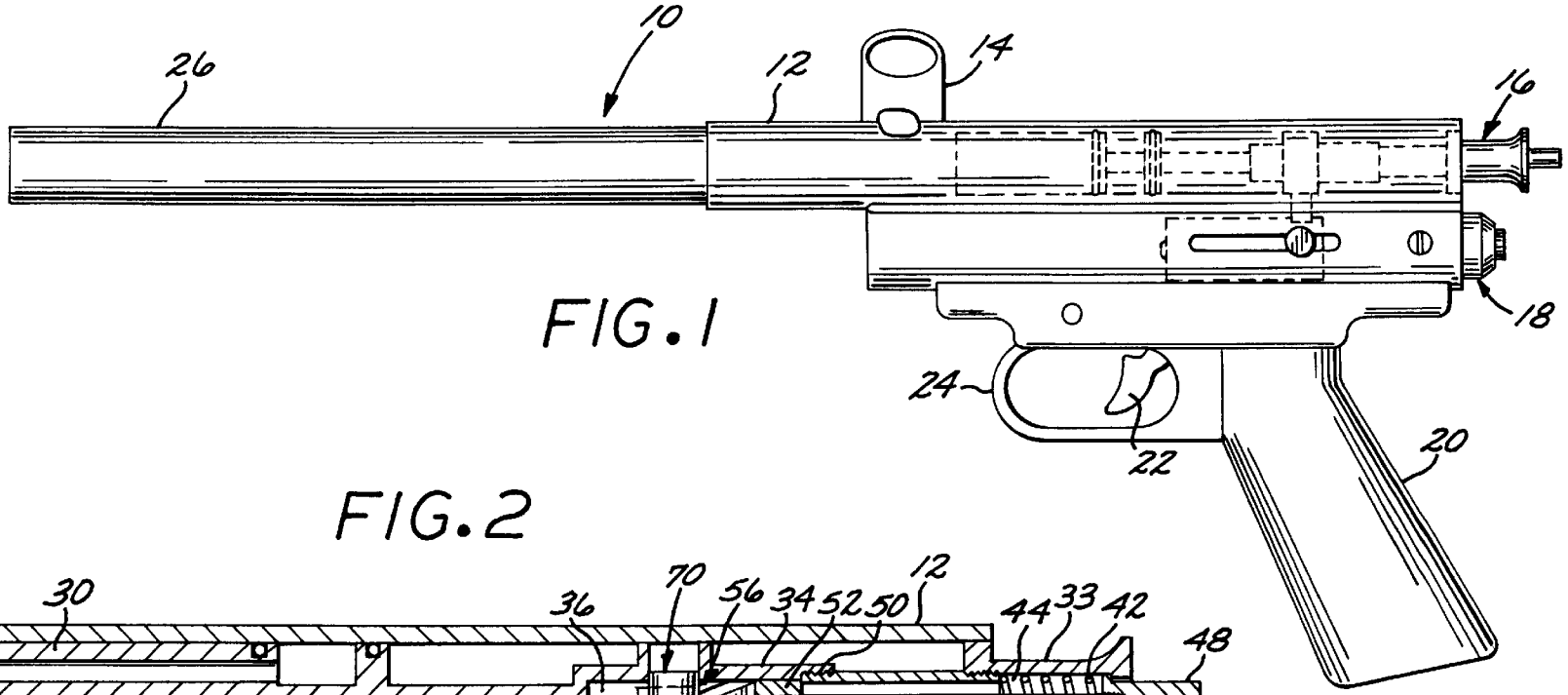
FIG. 1 is a perspective view partly broken away, showing the compressed gas powered gun of the present invention.

Referring now to FIG. 1, many parts of the compressed gas powered gun 10 of the present invention are conventional and are only shown to the extent necessary for an understanding of the present invention. Gun 10 comprises main body 12, feeder tube 14 which functions as a magazine to feed fragile projectiles, such as paint balls, bolt assembly 16, hammer, or cocking, assembly 18, receiver 20 for the gun body, trigger 22, trigger guard 24 and barrel 26.

Since the present invention is directed to am improved bolt assembly 16, the description that follows will be directed to the specific improvements made thereto.

Figure 2:
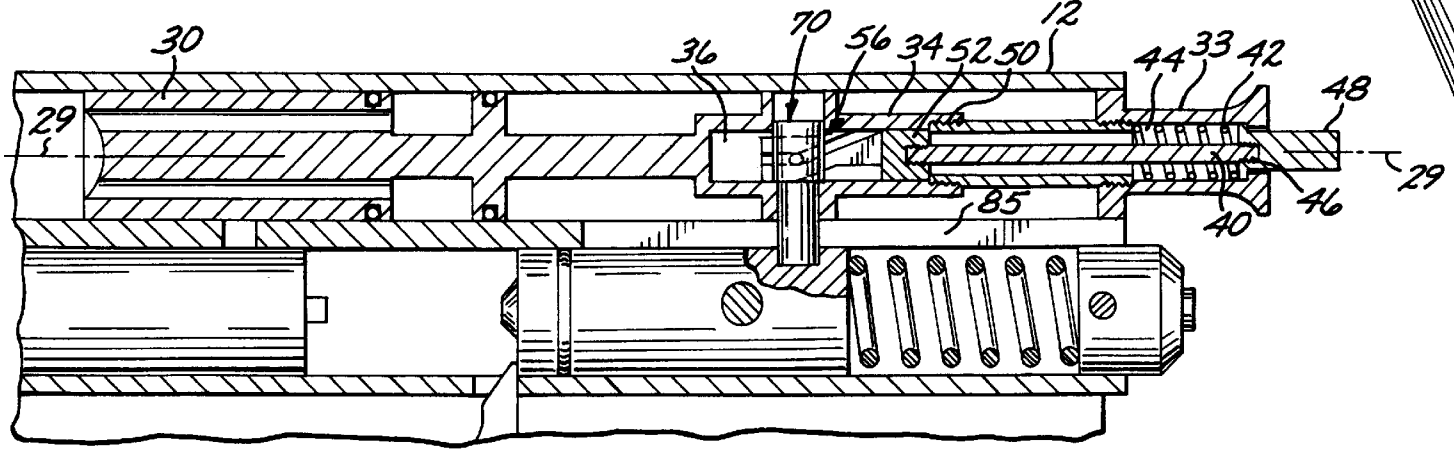
FIG. 2 is a cross-sectional view of a portion of the novel bolt assembly of the present invention and also showing the adjacent gun hammer mechanism.
Figure 7:
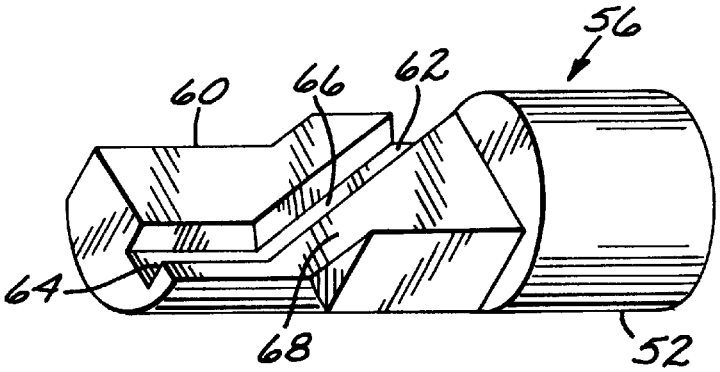
FIG. 7 is a perspective view of the novel channel member of the present invention.

Referring to FIG. 2, bolt assembly 16, designed to be moveable along longitudinal axis 29, comprises a front portion 30 for engaging a projectile and force it toward barrel 26, knob 33, and rear portion 34 having a recess 36 formed therein. Bolt assembly 16 further includes a cylindrical member 35 having threaded ends, one end connected to cylindrical portion 52, the other end connected to knob 33, and an elongated rod 40 having compression spring 42 positioned thereabout within cylindrical recess 44 formed in knob 33. Threaded end 46 of rod 40 is secured to pin head 48 which, in the position shown, extends beyond rear portion 32 of knob 33 and thus beyond main housing 12. Threaded end 50 of rod 40 is secured to portion 52 of channel member 56 positioned within recess 36. Channel member 56 (FIG. 7) comprises cylindrical portion 52, portion 60 which contains channel, or groove, 62 having a horizontal portion 64 and a inclined portion 66, and a ramped surface portion 68. Inclined portion 66 forms an angle to the longitudinal axis of bolt assembly 16.

A pin member 70 is also positioned in recess 36. Member 70 has a cylindrical shape with a cutout portion 72 formed between surfaces 74, 76, and 78. A guide pin 80 extends from surface 78 as illustrated.

Figure 3:
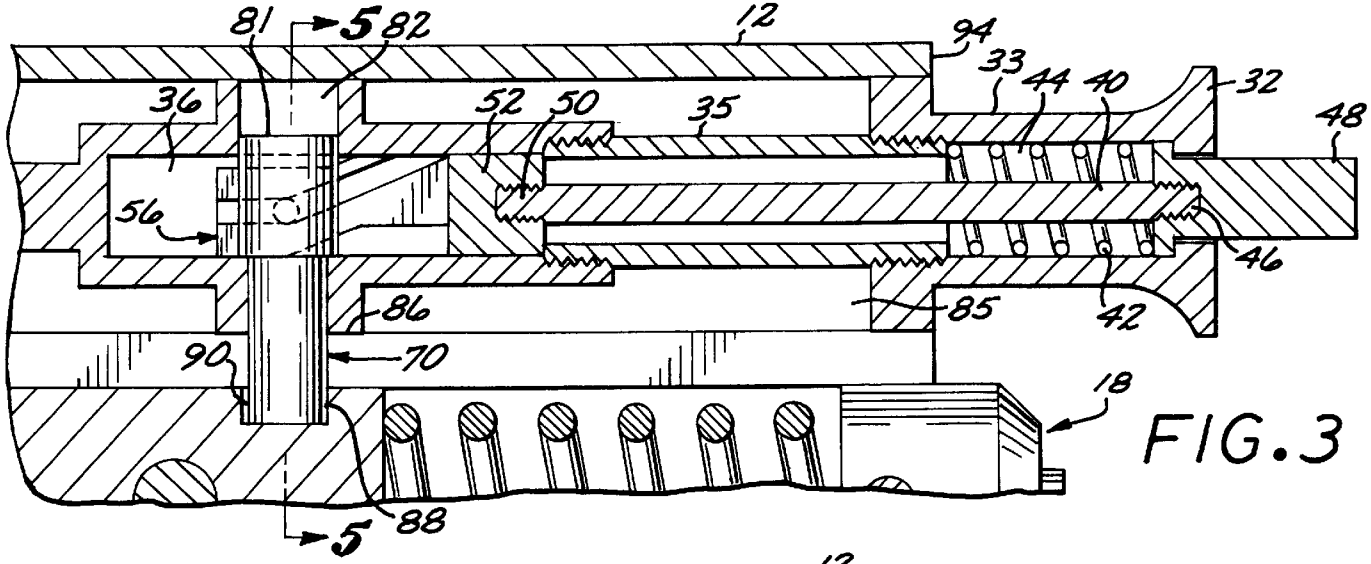
FIG. 3 is a more detailed sectional view showing the bolt assembly of the present invention attached to the cocking mechanism.

FIG. 3 illustrates bolt assembly 16 secured to hammer, or cocking, mechanism 18. Specifically, top portion 81 of member 70 is positioned in portion 82 of recess 36 and lower portion 84 of member 70 is positioned through a hole 86 formed in bolt assembly 16 and extends through a coaligned aperture 88 in mechanism 18 to the extent that portion 84 is received into aperture 90 formed in mechanism 18. Guide pin 80 is positioned in the horizontal channel portion 64 as illustrated. In this position, portion 84 is fully seated in aperture 88, bolt assembly 16 thus being secured to hammer mechanism 18 which in turn secures the bolt assembly 16 to gun 10.

Figure 4:
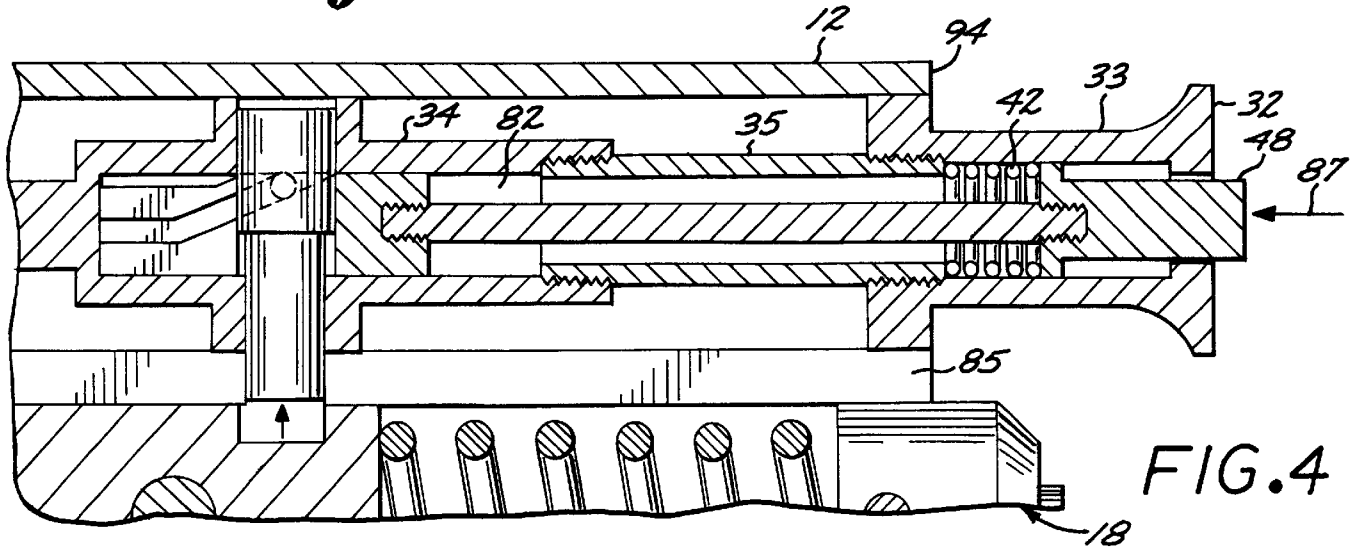
FIG. 4 is a sectional view showing the bolt assembly of the present invention in the process of being detached from the cocking mechanism.

Referring to FIG. 4, when it is desired to remove bolt assembly 16 from gun 10, a user grasps knob 33 with two fingers and then depresses pin head 48 inwardly in the direction of arrow 87. This compresses spring 42, causing member 52 to move in the direction of longitudinal axis 29 against portion 52 of channel member 56, forcing guide pin 80 to climb the ramped or inclined portion 66. This in turn causes member 70 to move upwardly, or vertically, with respect to longitudinal axis 29 within groove 82, lifting portion 84 from aperture 90 to a position within channel, or groove, 85 formed between bolt assembly 16 and mechanism 18 in the area illustrated in FIG. 2. Bolt assembly 16 is thus free to be removed from hammer mechanism 18 by pulling knob 33 in the opposite direction to arrow 87. As illustrated, far end of knob 33 is coupled to cylindrical portion 35, the opposite end of portion 35 being coupled to rear portion 34. Thus, pulling knob 33 in the direction opposite to arrow 87 enables bolt assembly 16 to be removed from the gun main housing 12 due to the integral connection of components 33, 34, and 35.

The process is reversed to reinstall bolt assembly 16. Specifically, the user depresses knob 48 as the bolt assembly 16 is reinserted into the bolt housing. This maintains portion 84 in its uplifted position. When the bolt assembly is inserted into the bolt housing such that knob 83 is flush with surface 94 of housing 12, knob 48 is released and lower portion 84 falls into aperture 90 due to the force of compression spring 42.

Figure 5:
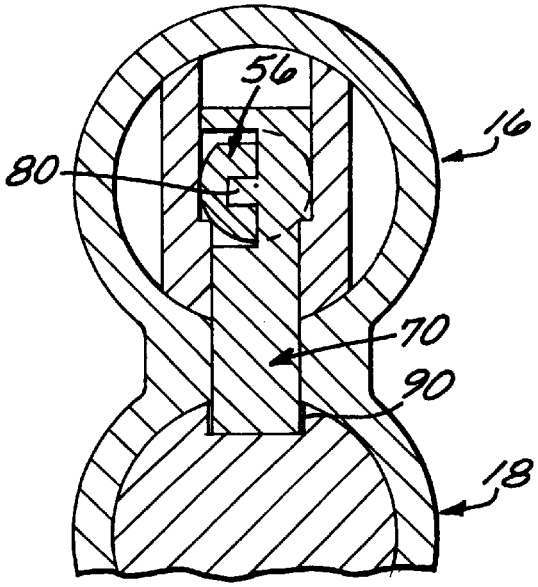
FIG. 5 is a cross-sectional view along line 5—5 of FIG. 3.
Figure 6:
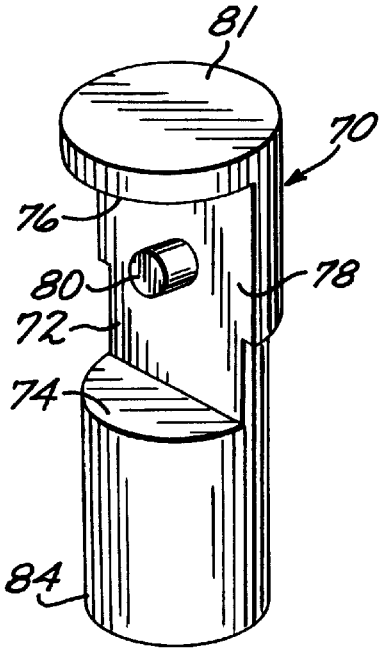
FIG. 6 is a perspective view of the novel pin member of the present invention.

FIG. 5 is a cross-sectional view along line 5—5 of FIG. 3 showing member 70 extending into recess 90 formed in hammer mechanism 18.

The present invention thus provides a simplified technique for removing the bolt assembly from a compressed gas gun, allowing the gun and chamber to be cleaned quickly and efficiently without special tooling.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. In a compressed gas powered gun for firing projectiles from the breech of a gun that includes a projectile supply magazine for feeding projectiles to the gun breech and a bolt assembly that rides within the main body of the gun for driving a projectile from the breech to the barrel for firing, the improvement comprising an improved bolt assembly that includes a member that extends beyond the main body of the gun, activation of said member enabling the bolt assembly to be removed from the gun main body.

2. In a compressed gas powered gun for firing projectiles from the breech of the gun that includes a projectile supply magazine for feeding projectiles to the gun breech and a bolt assembly having a longitudinal axis that rides within the main body of the gun for driving a projectile from the breech to the barrel for firing and a hammer mechanism, the improvement comprising a bolt assembly that can be easily removed from the main body of the gun, the bolt assembly comprising:

a pin member for securing the bolt assembly to the hammer mechanism, a portion of the gun member extending into an aperture formed in said hammer mechanism, said pin member being adapted to move in a direction substantially vertical to said longitudinal axis; and a first member for connecting said pin member to a first end of a second member, the other end of said second member causing said first member to lift said pin member from said aperture, thus enabling said bolt assembly to be removed from the main body of said gun.

3. The improvement of claim 2 wherein said pin member has a guide pin extending therefrom.

4. The improvement of claim 3 wherein said first member has a groove formed therein, said groove comprising a horizontal portion connected to an inclined portion extending at an angle to said longitudinal axis.

5. The improvement of claim 4 wherein said guide pin is positioned in said horizontal groove portion when said pin member is fully seated in said aperture.

6. The improvement of claim 5 wherein said guide pin moves along said inclined groove position as the other end of said second member is activated causing said pin member to be lifted out of said aperture, enabling said bolt assembly to be removed from the main body of said gun.

7. The improvement of claim 6 wherein said first member comprises an elongated rod.

8. The improvement of claim 7 wherein said second member is positioned within a knob member secured to the end of said main body.

9. The improvement of claim 8 further including a support positioned member within said main body to support said pin member and said knob member, said knob member being spaced apart from said pin member.

10. The improvement of claim 9 wherein said elongated rod is positioned within said support member and said knob member.

* * * * *